United States Patent [19]

Thrash

[11] 3,970,143

[45] July 20, 1976

[54] OIL WELL PRODUCTION SYSTEM

[75] Inventor: Sammy DeWitt Thrash, Tulsa, Okla.

[73] Assignee: Combustion Engineering, Inc., New York, N.Y.

[22] Filed: June 23, 1975

[21] Appl. No.: 589,329

[52] U.S. Cl. ..... 166/53; 166/62
[51] Int. Cl.[2] ..... E21B 43/00
[58] Field of Search ..... 166/58, 53, 54, 57, 166/62, 68, 75

[56] References Cited

UNITED STATES PATENTS

| | | | |
|---|---|---|---|
| 2,432,079 | 12/1947 | Albert, Jr. | 166/62 |
| 3,219,107 | 11/1965 | Brown, Jr. et al. | 166/53 |
| 3,782,463 | 1/1974 | Palmour | 166/68 |

*Primary Examiner*—James A. Leppink
*Attorney, Agent, or Firm*—Arthur L. Wade

[57] ABSTRACT

A number of oil wells each have a crude oil processing unit located at close to the wellhead. The clean oil produced from each processing unit is connected to supply the clean oil as hydraulic power oil and to sales. The sales output conduits are manifolded. The control system normally creates clean oil, which is excess over that required for pumping, to sales. The control system alternatively withdraws clean oil from the manifold if a well temporarily does not produce enough clean oil for pumping.

2 Claims, 2 Drawing Figures

OIL WELL PRODUCTION SYSTEM

BACKGROUND OF THE INVENTION

1. Field of the Invention

The present invention relates to providing power oil from oil well production. More specifically, the invention relates to processing production at the wellhead to provide short-travel for the high pressure processed oil to the downhole pump at the same time the excess is conducted to sales.

2. Description of the Prior Art

Hydraulic, downhole production pumps have long been a familiar tool in the oil field. Fluid (oil) is elevated to the order of 3,000 pounds per square inch to actuate the pump so it will bring oil well production to the surface. Kobe, Inc., a subsidiary of Baker Oil Tools, Inc., has been a leader in the manufacturing of the downhole pump and its hydraulic supply system.

There have been many attempts to provide an inexpensive source of hydraulic fluid for the downhole pumps. It is obvious that the oil produced is an available source. It is right there. It has the basic qualities needed for hydraulic fluid. On paper it is an ideal source.

Cleaning the produced crude oil for power oil has not been as easy as it looks on paper. At least cleaning it enough for use as hydraulic fluid in downhole pumps. The trouble centers around the solids which come with the production.

The familiar heater-treater has long been capable of separating produced water from oil. But the solids are another matter. The advent of the electric treating unit has helped this situation.

Petreco Division of Petrolite Corporation pushed its electric treater system into the power oil picture with an experimental installation on Long Beach Oil Development Co. property. Data on this research was published in paper SPE 3549 by Hettick and Lucas prepared for the 49th Annual Fall Meeting of the Society of Petroleum Engineers of AIME held Oct. 3–6, 1971 in New Orleans, Louisiana. Apparently a careful analysis was made over a two-year period of the ability of that system to remove water, particulate matter, and water-soluble salts from make-up oil supplied a closed power oil system. Make-up oil requirements reduced 50% and mechanical repair costs reduced 70%.

A student of this art might now conclude that a practical package would include an electric treater. However, such has not been the case. About three years ago, one of my competitors put together a unit to supply power oil. Surprisingly, the only processing unit was a separator with no heating or treating function. Of course, produced crude through this unit was gaseous and dirty. Further, a heater-treater was also required at the central tank battery to treat the crude for sale. Still, many of these units were sold in the past. Today the pump repairs and downtime have accumulated and the units fallen into bad repute.

I believe the position logical that no one has processed oil well production at the wellhead to the quality required by a hydraulic downhole pump with excess being sent directly to sales. Certainly no one has provided control to switch processed oil from storage to the pump when power oil demand exceeds production and automatically return excess production to sales when production exceeds power oil demand. A unit is needed which can provide these functions within an oil well production system for a number of oil wells.

SUMMARY OF THE INVENTION

The present invention provides, in the first instance, a crude oil processing unit located quite close to an oil well which is produced with a hydraulic pump. The processing unit normally supplies enough clean oil for both sales and the hydraulic pump. The output to sales is controlled to pass the excess quantity of processed oil to sales for periods in which the hydraulic pump demand is met and to make up from sales for periods in which the hydraulic pump demand exceeds the quantity of oil processed.

The invention provides, in the second instance, crude oil processing units at each of a plurality of oil wells. A manifold for the wells is provided between the sales run tank and the wells. With this system an adequate supply of power oil is assured for any of the wells which, for a short period, has a short-fall of produced oil over demand for power oil by its hydraulic downhole pump.

Other objects, advantages and features of this invention will become apparent to one skilled in the art upon consideration of the written specification, appended claims, and attached drawings, wherein;

FIG. 1 is a somewhat diagrammatic view of a number of oil wells with crude oil processing units at each well including the present invention; and FIG. 2 is a sectioned side elevation of a single installation of a processing unit in the system of FIG. 1.

DESCRIPTION OF THE PREFERRED EMBODIMENT

Figure 1:
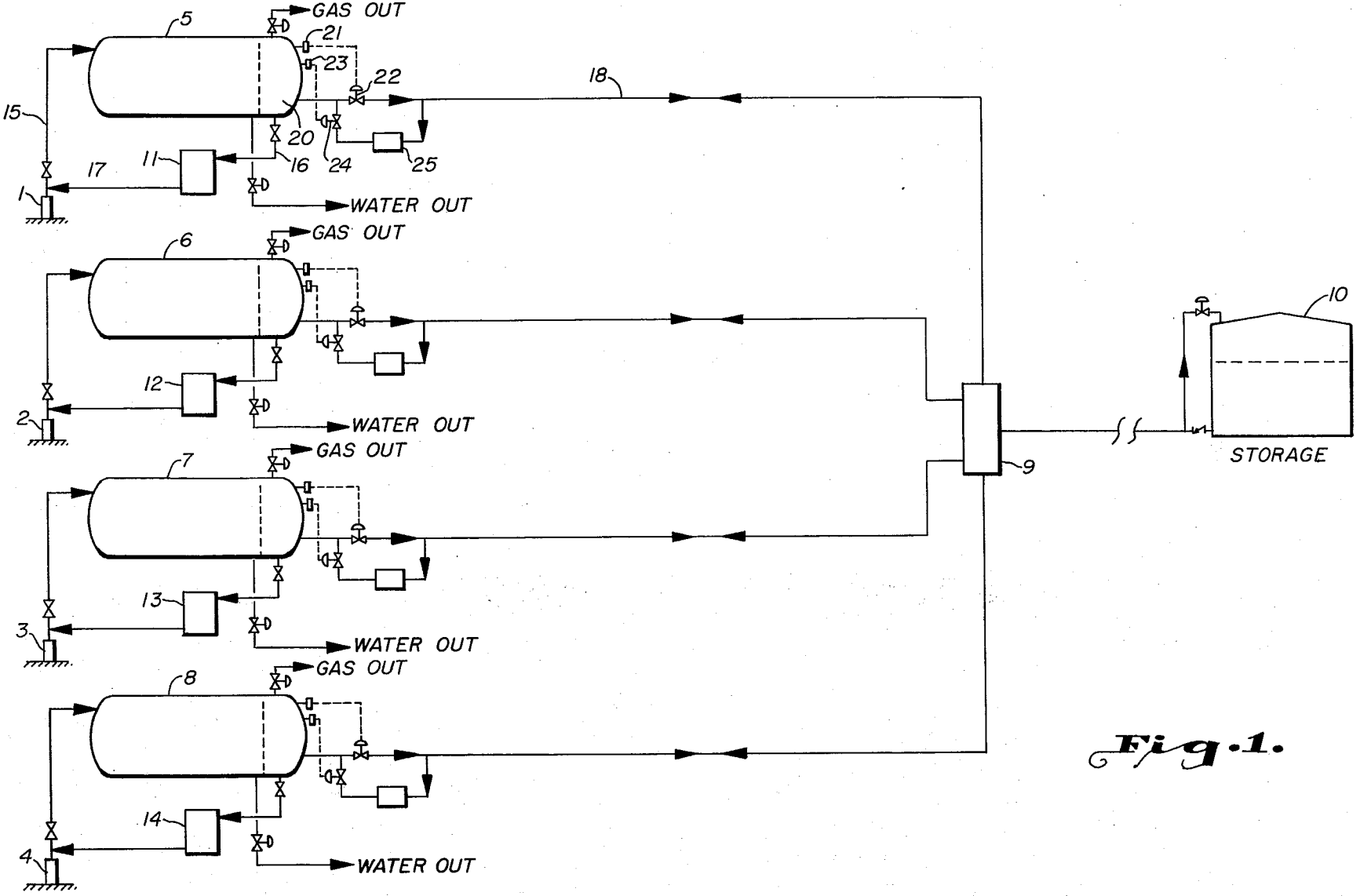

FIG. 1 discloses a number of oil wells 1–4. Each of the wells has a crude oil processor unit 5–8 near it. Each processor unit produces clean oil into a common manifold 9. Sales run tank 10 receives clean, or marketable, oil from manifold 9.

Each processing unit also supplies clean oil to a pump 11–14 which elevates the pressure on the clean oil to the order of 3,000 pounds per square inch. This high pressure oil is conducted down the well bore to power a hydraulic pump which brings all production of the well to the surface.

The concept is quite simple. Oil well production is produced from well 1 and flows through conduit 15 into processor unit 5. The produced fluids are separated and sent their separate ways. The crude oil is divided. First, a portion is withdrawn through conduit 16 and elevated in pressure by pump unit 11. The high pressure oil is then conducted through 17 back to well 1. Conduits 16 and 17 are quite short in length which is good, considering the dangerous level of their internal pressure.

The second portion of clean oil is flowed through conduit 18 into manifold 9. And there will be a second portion, flowing to manifold 9 as excess over the first portion, as long as more crude oil is flowed through conduit 15 out of well 1 than is required from conduits 16 and 17 by the unseen, downhole pump. If, for a period, the downhole pump demand exceeds the available oil through processor 5 the control system reverses the flow in conduit 18 and clean oil flows from manifold 9 to meet the demand of the downhole pump.

CONTROL CONCEPT

As described above, the system is controlled to normally pump production fluids out of each well, flow part of the oil back to the well to operate the downhole pump and flow the excess oil to storage. Take well 1 for example.

Processor 5 separates oil, water and gas. It does a good job. It has to do a good job because the oil produced must be of a quality which will operate the downhole pump without excessive wear with resulting maintenance and downtime. The traditional heater-treater might do this good a job with special features added. However, the electric treater is being proven as the oil production processor for the job.

Whatever processor used, it will have a compartment 20 into which cleaned, or processed, oil will be collected. Conduit 18 and conduit 16 are connected to compartment 20 to draw off their respective portons of the oil. One portion to the pump and the second portion to sales.

The level of the processed oil in compartment 20 is the key to operation of the control system. A level control 21 operates valve 22 in conduit 18 to insure that oil flows to sales so long as there is an excess of processed oil over that oil required to operate the downhole pump.

The control concept then contemplates the situation where production from well 1 will not be enough to operate the pump and provide an excess to sales. The level of oil in compartment 20 will fall below a predetermined level set by control 21. Valve 22 will close. All the oil produced will flow to the downhole pump.

If the level in compartment 21 continues to fall, control 23 will be actuated. Valve 24 will be opened. Pump 25 will be started. The flow in conduit 18 will be reversed. Oil will be drawn from manifold 9. Hopefully, the fall of the level in compartment 20 will be stopped. The demand of the downhole pump will be met. Again, hopefully, this short-fall of well 1 production will be short lived and the normal mode of control will be regained with there being an excess of processed oil for sales.

SUMMATION

The concept in this disclosed system I believe novel is that of having an effective oil processor close to the well with its processed oil being divided between the power requirements of the downhole pump and sales. The high pressure lines for the power oil are short while the lengthy conduit for the sales oil is under relatively low pressure.

The concept of the described system also includes the concept of the quantity of processed oil being sensed and controlling whether the oil will be divided between sales and the downhole pump or whether the oil sent to sales will be returned to operate the downhole pump. This concept is enlarged to include a plurality of wells producing to a common header so a short-fall in any one or more of the wells will have the remaining wells as a source for power oil until a decision is made to shut down the well with short-fall production.

FIG. 2

Figure 2:
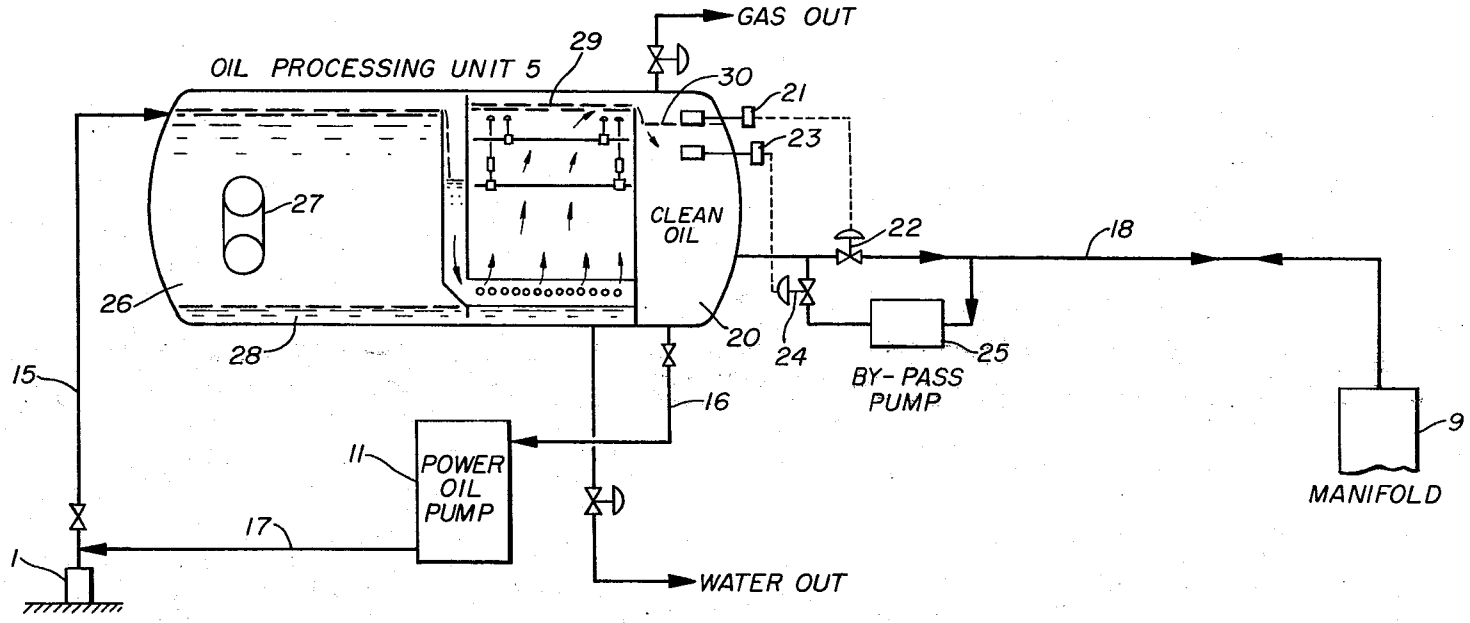

The disclosure of FIG. 2 is used to take one well of FIG. 1 and enlarge upon the disclosure of the system to make absolutely clear how everything works. Well 1 is selected and oil processing unit 5 is enlarged and sectioned to emphasize the importance of the electric type of processor in this system.

Electric treaters, or processors, are usually divided into at least three sections. First, the full production is flowed into a heating section. Second, the treating section is equipped to provide an electrostatic field to remove the lost water from the oil. Finally, the processed, or clean, oil is collected in the third section from which it is split to downhole pump and sales.

In heating section 26 I have indicated a source of heat 27 to give completeness to the disclosure. There is no point in going into any more detail. The heaters provided in electric treaters are well known. Their function is to adjust the temperature of all produced fluids, particularly that of the oil and water dispersed in the oil.

There may be significant amounts of water evolved and removed in the heating section 26. A layer 28 of such water is indicated along the lower portion of compartment 26. In any event, the remaining oil, and whatever water remains dispersed in it, is flowed into compartment 29.

In compartment 29 electrodes are indicated as mounted to generate an electrostatic field. There is little to be gained by disclosing details of the electrical gear associated with the electrodes. It is sufficient to indicate the electrodes as evidence that a field is established which effectively drops the remaining water to the bottom of compartment 29, the then processed oil flowing into compartment 20.

In compartment 20, level control 21 and level control 23 can be seen as essentially floats which respond to the vertical positions of level 30. In FIG. 2, level 30 is shown at what can logically be termed the normal height. Valve 22 is open to some extent, allowing oil in excess of that needed for the downhole pump to flow to manifold 9 through conduit 18. More lines and representation of detail would not add to the disclosure. The essentials are there.

CONCLUSION

The invention can now be spelled out more specifically against the drawing disclosure. First, I have a production system for crude oil. This system includes an oil well at 1 and a downhole pump which is unseen, but understood to be downhole of well 1. Crude oil processing unit 5 is mounted at well 1 and is connected by conduit 15 to receive all fluids produced from well 1 by the downhole pump. The processor unit 5 includes heater 27, a baffle arrangement which enables gas to be evolved and flow from the gas outlet disclosed and a baffle arrangement which enables water to be separated from the oil and flow from the water outlet disclosed. High pressure pump 11 receives the crude oil from compartment 20 and is connected to the downhole pump with conduit 17 to supply the crude oil as power fluid. A storage 10 received the excess crude oil processed. Level controls 21, 23 actuate valves 22, 24 and bypass pump 25 to shuttle processed oil from storage when the output from well 1 falls below the excess of oil required to actuate the downhole pump.

The production system is also disclosed as including a number of wells 1–4. Each well is equipped as disclosed in connection with well 1. Therefore, a system is provided which can supply one or more wells with power oil from the common storage during a period when the volume of production falls to where there is no excess from the one or more wells. Eventually, of course, the well, or wells, so served must come back on line or be shut down.

From the foregoing, it will be seen that this invention is one well adapted to attain all of the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

The invention having been described, what is claimed is:

1. A production system for crude oil, including;

an oil well;

a downhole pump actuated by high pressure hydraulic fluid;

a crude oil processing unit located at the oil well and connected to the downhole pump to receive fluids produced from the oil well and including, a. means connected to the unit which heat the fluids, b. means connected to the unit which degas the liquids, c. means connected to the unit which electrostatically separate the liquids into clean crude oil and water, d.and a compartment within the unit arranged to receive the clean crude oil;

a high pressure pump connected to the clean oil compartment to receive the clean oil and connected to the downhole pump to supply the clean oil as the actuating hydraulic fluid;

a storage facility connected to the clean oil compartment to receive all the clean oil processed in excess of the quantity received by the high pressure pump;

and a control system connected between the storage facility and clean oil compartment and arranged to return processed clean crude oil to the high pressure pump from the storage facility during periods when the oil well output of the processing unit is less than the amount required to actuate the downhole pump.

2. The production system of claim 1 in which the control system includes:

level controls mounted in the clean oil compartment of the processing unit and arranged to sense predetermined high and low levels of the clean oil and establish signals representative of each level, and a valve system mounted in the connection between the clean oil compartment and storage and controlled by the signals of the level controls to connect the clean oil compartment and storage to flow clean oil to storage for a period when the high level signal indicates the quantity of processed crude oil produced is greater than the quantity required to operate the downhole pump and to flow processed crude oil from storage for a period when the low level signal indicates the quantity of processed crude oil produced is less than the quantity required to operate the downhole pump.

* * * * *